US005465864A

United States Patent [19]

McClean

[11] Patent Number: 5,465,864

[45] Date of Patent: Nov. 14, 1995

[54] VENTING THERMOPLASTIC CONTAINER FOR A PACKAGE WITH A BLADDER SYSTEM

[75] Inventor: Craig E. McClean, Toledo, Ohio

[73] Assignee: Owens-Illinois Plastic Products Inc., Toledo, Ohio

[21] Appl. No.: 272,983

[22] Filed: Jul. 15, 1994

[51] Int. Cl.[6] ..... B65D 83/00

[52] U.S. Cl. ..... 220/403; 220/404

[58] Field of Search ..... 220/366, 403, 220/404, 397

[56] References Cited

U.S. PATENT DOCUMENTS

| | | | |
|---|---|---|---|
| 2,629,421 | 2/1953 | Ayres | 220/366 |
| 2,816,690 | 12/1957 | Lari | 222/92 |
| 3,181,720 | 5/1965 | Cassie et al. | 220/366 |
| 3,484,011 | 12/1969 | Greenhalgh et al. | 215/12 |
| 3,645,414 | 2/1972 | Barr | 215/11 |
| 3,698,595 | 10/1972 | Gortz et al. | 220/63 |
| 3,756,367 | 9/1973 | Mitchell et al. | 188/352 |
| 3,770,154 | 11/1973 | Johnson | 215/11 |
| 3,791,557 | 2/1974 | Venus, Jr. | 222/105 |
| 3,834,570 | 9/1974 | Barr | 215/11 |
| 5,121,858 | 6/1992 | Chong | 220/366 |
| 5,364,075 | 11/1994 | Guannello et al. | 220/366 |

*Primary Examiner*—Joseph Man-Fu Moy

[57] ABSTRACT

A molded plastic container (10, 110, 310) having an open neck portion (12, 112, 212), the container being adapted to have a collapsible bladder (B) inserted therein. The bladder has a metallic ferrule (F) at an open end thereof, and the ferrule is adapted to be supported at a location adjacent a rim (14, 114, 214) of the neck portion. To provide for venting from the container during the filling of the bladder, and later during the dispensing of product therefrom, the rim is provided with a plurality of spaced apart upstanding bosses (16, 116, 216) which define slots (18, 118, 218) between adjacent ends of adjacent bosses. The ferrule, thus, rests on the bosses, and air can vent beneath the ferrule and the container through the slots. The container can also vent during dispensing, even with a closure C affixed thereto, by providing a radial bead (22, 122, 222) in the container with a plurality of longitudinally extending slots (24, 124, 224) in the exterior thereof. Further, venting of the container, in the region between a juncture of the neck portion and a shoulder portion (26, 126, 226) and the portion of the bladder surrounded by such region can be accomplished by providing a circumferentially spaced apart series of radially outwardly projecting dimples (28, 128) and, if need be, by providing a circumferentially spaced apart plurality of longitudinally extending recesses (130, 230) on the inside of the open neck portion (112, 212).

20 Claims, 4 Drawing Sheets

VENTING THERMOPLASTIC CONTAINER FOR A PACKAGE WITH A BLADDER SYSTEM

FIELD OF THE INVENTION

This invention relates to a rigid, molded thermoplastic container of the type used with a bladder system in the packaging of a fluid product. More particularly, this invention relates to a container of the foregoing character which is self-venting in its as molded condition.

BACKGROUND OF THE INVENTION

Many fluid products are packaged in a collapsible bladder, with a suitable closing and dispensing system, after the bladder has been inserted into a rigid, molded plastic container through the finish of the container. A container of this type must be able to vent the portion of its interior that is exterior to the bladder to accommodate expansion of the bladder during its filling with the fluid product, and then to accommodate collapse of the bladder as the fluid product is dispensed therefrom. Heretofore, these venting requirements have been met by drilling a hole in the bottom of the container at a location away from the exterior of the bladder in a separate, post-molding operation. This post-molding operation adds to the cost of manufacture of containers of this type in a production operation, and it can restrict the productive capacity of a container blowing machine.

SUMMARY OF THE INVENTION

According to the present invention there is provided a rigid, molded plastic container which is suited for receiving a collapsible bladder that is adapted for the packaging of a fluid product therein, the container being self-venting in its as molded condition, thereby eliminating the need for a postmolding operation to provide the container with its required venting characteristics. Such a container is able to provide a suitable vent opening therein, both during the filling of the bladder with fluid to be packaged therein, when no closure is affixed to the container, and thereafter when product is dispensed from the container while the closure is affixed thereto.

A container according to the present invention has a closure receiving finish portion surrounding a neck opening into the container. A collapsible bladder, such as an elastomeric bladder, is inserted into the body of the container through the neck opening, and the bladder is provided with a metallic collar or ferrule. The ferrule, which has an outside diameter that is greater than the inside diameter of the container neck, rests on the top of the container neck. To vent air from the interior of the container during the filling of the bladder, the top of the container neck is provided with a spaced apart plurality of arcuately shaped slots therein, each slot having a depth that extends a short distance parallel to the central axis of the container neck. The arcuately shaped slots, and preferably there are four which are circumferentially spaced apart, permit air from the space within the container and exterior to the bladder to escape or vent therethrough during the filling of the bladder.

Further, to ensure that the container can vent during the filling of the bladder, the interior of the container neck may be provided with one or more slots therein that extend parallel to the central axis of the container throughout the length of the neck, in the region of the neck which could otherwise be sealed by virtue of the small radial clearance that normally exists between the interior of the container neck and the exterior of the portion of the bladder that is surrounded by the neck. Each longitudinal slot, and preferably there a plurality which are circumferentially spaced apart, has a radial depth that is somewhat less than the radial thickness of the container neck.

A package having a container of the type described is normally sold with a closure affixed thereto, typically a closure of the type which receives a pump member to permit dispensing of the product from the container without removal of the closure. Thus, a container of the type described must be capable of venting during dispensing of the product from the container with the closure still in place. A container of the type described may readily be provided with venting characteristics during dispensing with the closure in place by providing one or more slots extending parallel to the longitudinal axis of the container in the exterior of a radially outwardly projecting bead in the finish of the container, such bead engaging a radially inwardly projecting bead in a closure that can be affixed to the neck of the container in a snap fit resulting from an interference between the bead of the closure and the bead of the container.

Accordingly, it is an object of the present invention to provide an improved molded plastic container for use in packaging a fluid product in a collapsible bladder. It is a further object of the present invention to provide a molded plastic container of the foregoing character that is self-venting in its as molded condition during the filling of the bladder with the packaged product. It is also an object of the present invention to provide a container of the foregoing character that is self-venting in its as molded condition during dispensing of the packaged product from the bladder with a closure of the snap-on type affixed to the container.

For a further understanding of the present invention and the objects thereof, attention is directed to drawing and to the following brief description thereof, to the detailed description of the preferred embodiment of the invention and to the appended claims.

DETAILED DESCRIPTION OF THE PREFERRED EMBODIMENT

Figure 1:
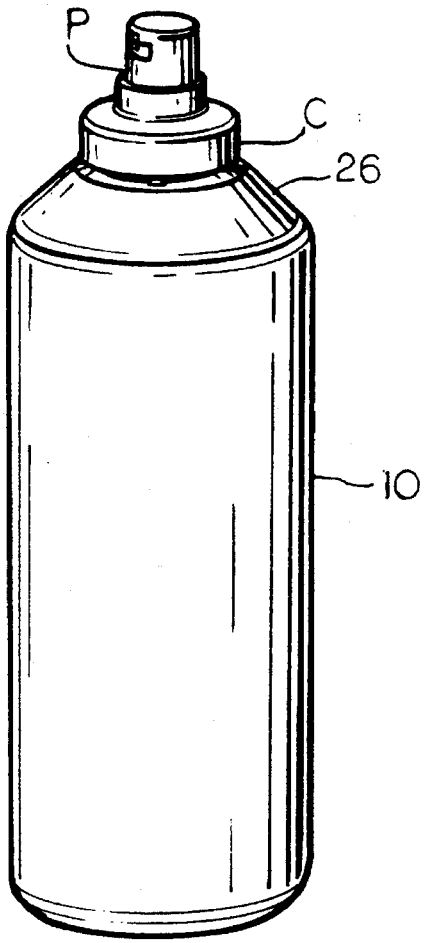
FIG. 1 is a perspective view of a package which includes a container according to the preferred embodiment of the present invention.
Figure 2:
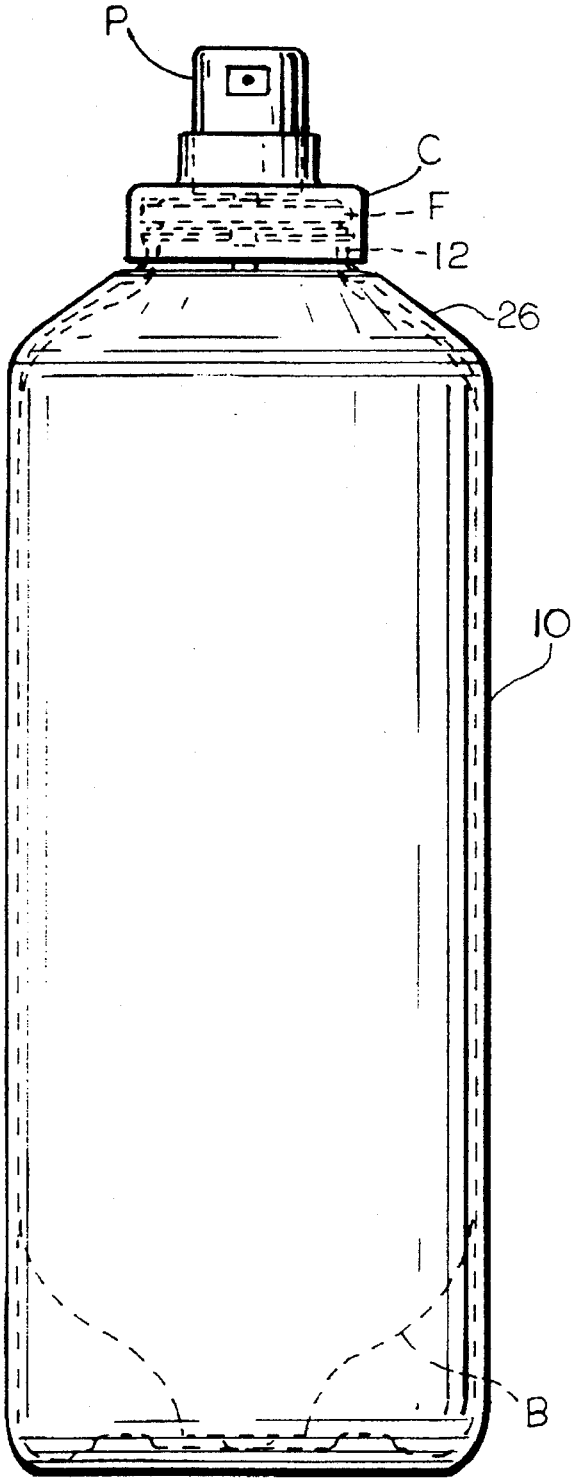
FIG. 2 is an elevational view, at an enlarged scale, of the package of FIG. 1.
Figure 3:
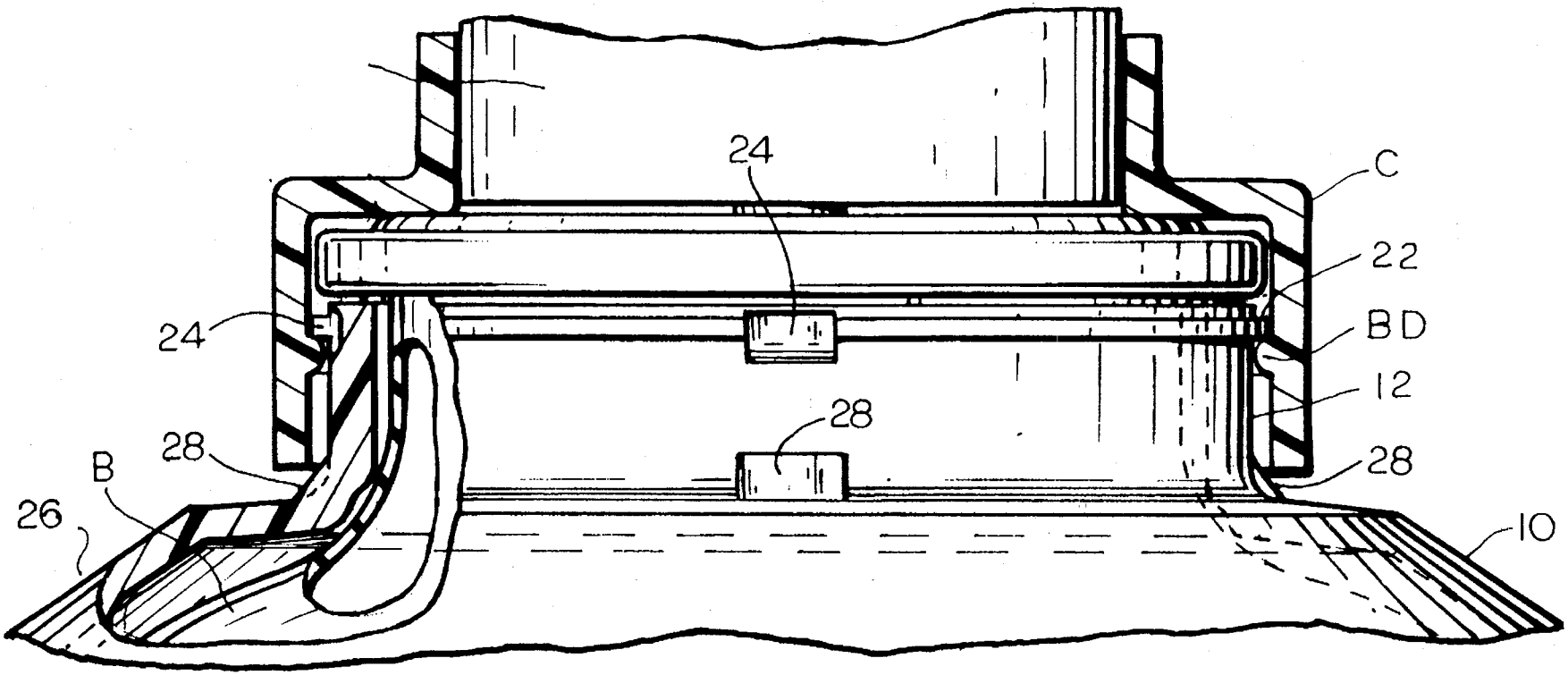
FIG. 3 is fragmentary sectional view, at a further enlarged scale, of the package of FIGS. 1 and 2.
Figure 4:
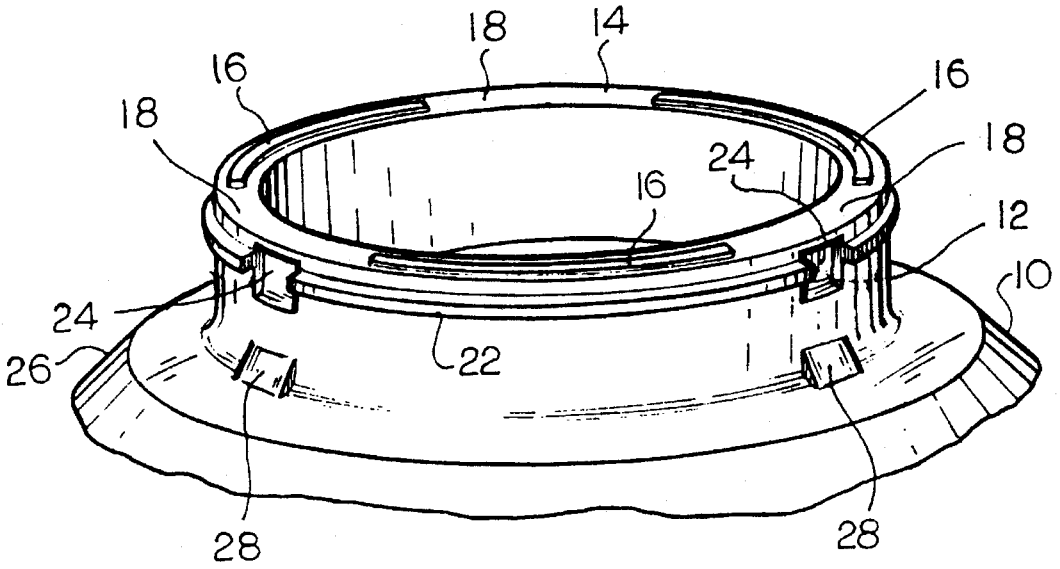
FIG. 4 is a fragmentary perspective view of a portion of the container of the package of FIGS. 1–3.

A container according to the preferred embodiment of the present invention is identified by reference numeral 10 in FIGS. 1–4, and is molded from a thermoplastic material, such as high density polyethylene. Containers corresponding to the container 10 may be produced in quantity by a variety of known container molding processes, such as the continuous extrusion shuttle blow molding process, the injection blow molding process, the Owens-Illinois BC-3 process or the stretch and blow molding process. The container 10 is designed to be used in the packaging of a fluid in a collapsible bladder, such as an elastomeric bladder, which is identified by reference character B in FIGS. 2 and 3, and is designed to be closed, after the bladder B is filled with the product to be packaged, by a molded plastic or other closure C through which a dispensing pump P extends. The bladder B has a metallic collar or ferrule F sealingly secured to a filling and dispensing opening of the bladder B, and the ferrule F has an outer diameter that is greater than the inner diameter of an annular neck portion 12 of the container 10.

The neck portion 12 of the container 10 has a rim 14 that extends horizontally in the normal upright orientation of the container 10. The rim 14 is provided with one or more, shown as three, ribs or bosses 16 extending upwardly from the rim 14, and circumferentially with respect to the rim 14. The bosses 16 collectively have an arcuate extent of less than 360°, and provide support for the underside of the ferrule F of the bladder B when the bladder B is in position in the interior of the container 10. Thus, during the filling of the bladder B, air can escape or vent from the portion of the container 10 that is external to the bladder B through arcuate slots 18, which exist in the rim 14 of the container 10 between the ends of the bosses 16. In that regard, the adjacent ends of each adjacent pair of bosses 16 are circumferentially spaced apart from one another.

The exterior of the neck portion 12 of the container 10, which is usually referred to as a finish, is provided with a radially outwardly projecting bead 22. The bead 22 has an outer or tip diameter (the "T" diameter in industry terminology) which is greater than the inner or tip diameter of an inwardly projecting bead BD in the closure C. Thus, the closure C may be affixed or secured to the container 10 by a snap or interference fit between the bead BD of the closure C and the bead 20 of the container 10, preferably with an upper surface portion of the bead BD being in positive engagement with a lower surface portion of the bead 20.

To provide for venting of the container 10 with the closure C applied to the neck portion 12 of the container 10, as product is gradually dispensed from the bladder B, the bead 22 of the container 10 is provided with one or more longitudinally extending slots 24 ensure that no seal will be formed between the underside of the bead 22 of the container 10 and the upper side of the bead of the closure C.

To ensure that no seal will be formed between the exterior of the bladder B and a juncture between the neck portion 12 and a shoulder portion 26 of the container 10, which extends radially outwardly and longitudinally downwardly from the neck portion 12, one or more dimples 28, shown as three of such dimples, are formed at such juncture, preferably in longitudinal alignment with the slots 24. Each such dimple 28 will draw the material of the container in the region of the dimple 28 outwardly to provide sufficient material to form the dimple 28, and this will ensure that one or more airflow paths will exist between the bladder B and the juncture of the neck portion 12 and the shoulder 26 of the container 10.

Figure 5:
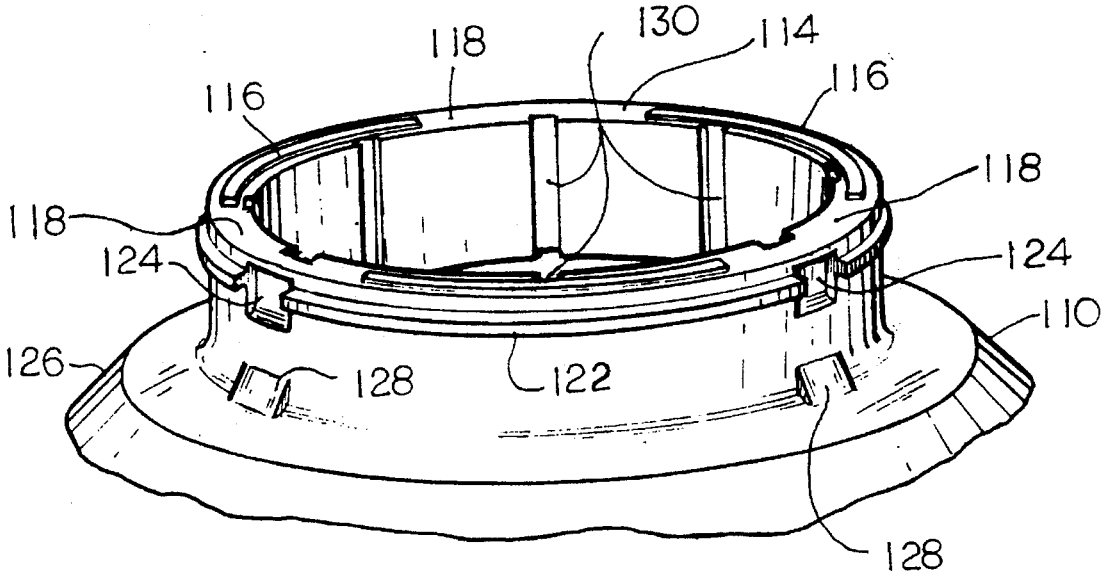
FIG. 5 is a view similar to FIG. 4 of an alternative embodiment of a container according to the present invention.

In the embodiment of FIG. 5, elements which correspond to the elements of the embodiment of FIGS. 1–4 are identified by a one-hundred series three digit numeral, the last two digits of which correspond to the digits of the corresponding element of the embodiment of FIGS. 1–4. Thus, in the embodiment of FIG. 5, there is provided a molded plastic container 110 with an annular neck portion 112. The neck portion 112 differs from the neck portion 12 of the container 10 in that the neck portion 112 has a plurality of circumferentially spaced apart longitudinally extending recesses 130 formed in the inside surface thereof. Each of the recesses 130 has a radial depth that is less than the radial thickness of the neck portion 112 where such recess 130 is located.

The presence of the recesses 130 in the neck portion 112 will ensure that no seal can be formed between the interior of the neck portion 112 and the exterior of a portion of a bladder B which is surrounded by the neck portion.

Figure 6:
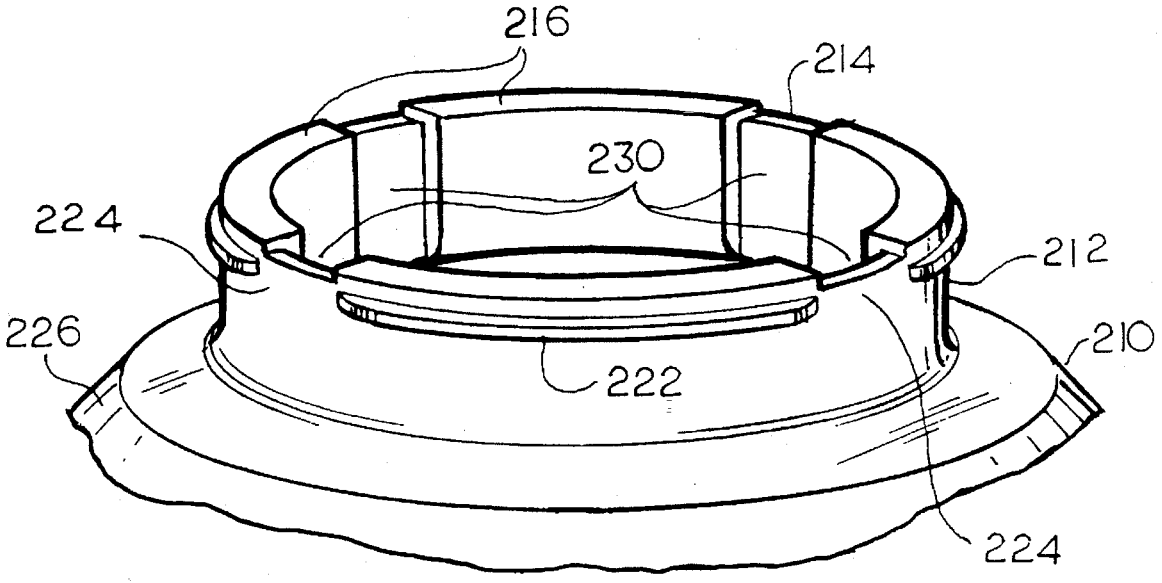
FIG. 6 is a view similar to FIGS. 4 and 5 of another alternative embodiment of the present invention.

In the embodiment of FIG. 6, elements which correspond to the elements of the embodiment of FIGS. 1–4 are identified by a two-hundred series three digit numeral, the last two digits of which correspond to the digits of the corresponding element of FIGS. 1–4. Thus, in the embodiment of FIG. 6 there is provided a molded plastic container 210 with an annular neck portion 212. The neck portion 212 has a rim 214 which extends horizontally in the normal upright orientation of the container 210. The rim 214 is provided with one or more, shown as four, bosses 216 extending upwardly from the rim and circumferentially with respect to the rim 214. The bosses 216 differ from the bosses 16 of the container 10 and the bosses 116 of the container 110 in that each of the bosses 216 has a radial thickness that is greater than the radial thickness of the portion of the rim 214 from which it projects, with a portion of each of the bosses 216 projecting radially inwardly past the radial innermost portion of such portion of the rim 214.

The container 210 also differs form the container 10 and the container 110 in that the portions of the bead 222 adjacent each of the slots 224 is tapered inwardly into the exterior of the portion of the neck 212 therebelow to avoid sharp corners in the molding of the container 210.

Although the best mode contemplated by the inventor(s) for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A container having an annular open neck with a rim and being adapted to receive a collapsible bladder through said open neck, the bladder being adapted to have a fluid packaged therein after the bladder is inserted into said container and having an annular ferrule at an opening thereinto, the ferrule being adapted to seat on said open neck of said container, said container comprising:

vent means formed in said open neck of said container below the portion of said open neck against which the ferrule is adapted to seat, said vent means permitting the escape of air from said container as the bladder is being filled with the fluid to be packaged therein;

wherein said vent means comprises a plurality of arcuately-extending bosses projecting upwardly from said rim in a direction extending generally parallel to a longitudinal central axis of said container, the adjacent ends of adjacent bosses in said plurality of bosses being spaced apart from one another to define a plurality of slots in said rim; and wherein said container is formed from a thermoplastic material by molding.

2. A container according to claim 1 wherein each of the bosses has a radial thickness that is greater than the radial thickness of the portion of the rim from which it projects, with a portion of said each of the bosses projecting radially inwardly beyond the radially innermost portion of said portion of the rim.

3. A container according to claim 2 wherein said bosses are formed integrally with said container in a single piece.

4. A container according to claim 1, said container having a bead projecting radially outwardly from said open neck and being adapted to be closed by a closure having a bead projecting radially inwardly therefrom, the bead of the closure being adapted to engage said bead of said container in an interference fit to secure the closure to said container, said bead of said container comprising:

second vent means in an outermost portion of said bead of said container, said second vent means extending generally parallel to the longitudinal central axis of said container, said second vent means in combination with said vent means permitting air to enter said container while the closure is secured to said container as the fluid is being dispensed from the bladder.

5. A container according to claim 4 wherein said second vent means comprises a plurality of circumferentially spaced apart vents.

6. A container according to claim 5 wherein the number of vents in said second vent means is at least as great as the number of slots in said vent means, each of the slots in said vent means being circumferentially aligned with one of said slots in said second vent means.

7. A container according to claim 1 wherein said container further comprises a neck portion joined to said open neck at a juncture away from said rim and further comprising:

a plurality of circumferentially spaced apart outwardly projecting dimples at said juncture, said dimples permitting venting of said container between the inside of said container in a region of said juncture and the portion of the bladder in the region of said juncture.

8. A container according to claim 7 wherein the number of said dimples is at least equal to the number of said vents, each of said dimples being circumferentially aligned with one of said slots.

9. A container according to claim 5 wherein said container further comprises a neck portion joined to said open neck at a juncture away from said rim and further comprising:

a plurality of circumferentially spaced apart outwardly projecting dimples at said juncture, said dimples permitting venting of said container between the inside of said container in a region of said juncture and the portion of the bladder in the region of said juncture.

10. A container according to claim 9 wherein the number of said dimples is at least equal to the number of said vents, each of said dimples being circumferentially aligned with one of said slots.

11. A container according to claim 10 wherein said third vent means comprises:

a circumferentially spaced apart plurality of recesses in said inside surface of said annular open neck, each said recess having a radial depth less than a radial thickness of a portion of said annular open neck in which said recess is located.

12. A container according to claim 1 and further comprising:

third vent means formed on an inside surface of said annular open neck, said third vent means extending generally transversely of said vent means and, in combination with said vent means, permitting the escape of air from said container as the bladder is being filled with the fluid to be packaged therein not withstanding any contact between the bladder and said inside surface of said annular open neck.

13. A container according to claim 12 wherein said third vent means comprises:

a circumferentially spaced apart plurality of recesses in said inside surface of said annular open neck, each said recess having a radial depth less than a radial thickness of a portion of said annular open neck in which said recess is located.

14. A container according to claim 4 and further comprising:

third vent means formed on an inside surface of said annular open neck, said third vent means extending generally transversely of said vent means and, in combination with said vent means, permitting the escape of air from said container as the bladder is being filled with the fluid to be packaged therein not withstanding any contact between the bladder and said inside surface of said annular open neck.

15. A container according to claim 14 wherein said third vent means comprises:

a circumferentially spaced apart plurality of recesses in said inside surface of said annular open neck, each said recess having a radial depth less than a radial thickness of a portion of said annular open neck in which said recess is located.

16. A container according to claim 7 and further comprising:

third vent means formed on an inside surface of said annular open neck, said third vent means extending generally transversely of said vent means and, in combination with said vent means, permitting the escape of air from said container as the bladder is being filled with the fluid to be packaged therein not withstanding any contact between the bladder and said inside surface of said annular open neck.

17. A container according to claim 16 wherein said third vent means comprises:

a circumferentially spaced apart plurality of recesses in said inside surface of said annular open neck, each said recess having a radial depth less than a radial thickness of a portion of said annular open neck in which said recess is located.

18. A one-piece, molded container, said container having an annular open neck with a rim and being adapted to receive a collapsible bladder through said open neck, the bladder being adapted to have a fluid packaged therein after the bladder is inserted into said container and having an annular ferrule at an opening thereinto, the ferrule being adapted to seat on said open neck of said container, said container comprising:

a plurality of arcuately-extending bosses projecting upwardly from said rim in a direction extending generally parallel to a longitudinal central axis of said container, the adjacent ends of adjacent bosses in said plurality of bosses being spaced apart from one another to define at least one slot in said rim, the ferrule being adapted to seat against said plurality of bosses, said at least one slot being adapted to permit the escape of air from said container as the bladder is being filled with the fluid to be packaged therein;

a bead projecting radially outwardly from said open neck of said container, said container being adapted to be closed by a closure having a bead projecting radially inwardly therefrom, the bead of the closure being adapted to engage said bead of said container in an interference fit to secure the closure to said container;

at least one vent in said bead, said at least one vent extending generally parallel to the longitudinal central axis of said container, said at least one vent, in combination with said at least one slot, being adapted to permit air to enter said container while the closure is secured to said container as fluid is being dispensed from the bladder.

19. A container according to claim 18 wherein said at least one slot and said at least one vent are circumferentially aligned.

20. A container according to claim 18 and further comprising:

at least one recess in an inside surface of said annular open neck, said at least one recess extending generally transversely of said at least one slot and, in combination with said at least one slot, being adapted to permit the escape of air from said container as the bladder is being filled with the fluid to be packaged therein notwithstanding any contact between the bladder and said inside surface of said annular open neck, said at least one recess having a radial depth less than a radial thickness of the portion of said annular open neck in which said at least one recess is located.

* * * * *